United States Patent [19]

Marker

[11] 4,107,482

[45] Aug. 15, 1978

[54] ROTARY ROCKING-BEAM SWITCH

[75] Inventor: Harry Rudolph Marker, Costa Mesa, Calif.

[73] Assignee: Electronic Engineering Co. of California, Santa Ana, Calif.

[21] Appl. No.: 763,766

[22] Filed: Jan. 31, 1977

[51] Int. Cl.[2] ..... H01H 19/60; H01H 21/80; H01H 1/12

[52] U.S. Cl. ..... 200/6 B; 200/11 R; 200/153 LB; 200/238; 200/275

[58] Field of Search ..... 200/1 R, 1 B, 5 A, 6 R, 200/6 B, 6 BA, 6 BB, 11 R, 11 G, 11 J, 11 K, 11 TW, 153 LB, 238, 239, 275, 291, 303

[56] References Cited

U.S. PATENT DOCUMENTS

| | | | |
|---|---|---|---|
| 3,261,928 | 7/1966 | Schlesinger, Jr. | 200/275 X |
| 3,304,491 | 2/1967 | Adams | 200/275 X |
| 3,346,708 | 10/1967 | Morra | 200/11 G |
| 3,903,383 | 9/1975 | Marker | 200/11 TW |
| 3,941,964 | 3/1976 | Yoder | 200/5 A X |
| 3,952,278 | 4/1976 | Kiyono | 200/153 R X |
| 3,973,091 | 8/1976 | Kaminski | 200/5 A |
| 3,975,601 | 8/1976 | Whelan | 200/11 R |
| 3,999,021 | 12/1976 | Delp | 200/11 TW X |
| 4,025,738 | 5/1977 | Erwin et al. | 200/6 B X |

*Primary Examiner*—James R. Scott
*Attorney, Agent, or Firm*—Harry R. Lubcke

[57] ABSTRACT

A rotary plural contact switch in which a walking-beam-like conductor is incrementally moved to break electrical contact with stationary contacts. This movement is brought about by a revolvable cam rotor. The basic double-contact mechanical structure may be multiplied; thus, switching functions related to digital circuits can be performed. The switch is particularly adapted for small-size embodiments. The external portion of the contacts are spaced to enter an integrated circuit socket, or a printed circuit board having terminals spaced according to the standard grid.

A tang on the internal portion of each contact is used to assemble the insulating enclosure of the switch by simple linear pressure upon the housing and the base parts of the enclosure.

12 Claims, 11 Drawing Figures

ROTARY ROCKING-BEAM SWITCH

BACKGROUND OF THE INVENTION

This invention pertains to low current multiposition rotary switches.

In order to attain small size the art has recently employed a rotative cam of insulating material for pressing a movable cantilever contact against a fixed contact. This normally gives an open electrical contact, one that is closed by actuation of the cam.

One embodiment has employed one cam for one set of contacts on an individual basis, and a cam rotation of the order of 20°.

Another embodiment employs a group of axially adjacent cams, one for each pair of cantilever arm switch contacts, which may be arranged to accomplish single-pole double-throw switching.

A push-button keyboard has employed a spring movable contact resting upon two stationary contacts. Depressing the push-button bends the movable contact to touch a third centrally located stationary contact. This gives normally-open single-pole single-throw switching.

BRIEF SUMMARY OF THE INVENTION

The switch is contained within an insulative enclosure. This has an upper hollow housing and a lower base. The stationary contacts have the form of posts and are typically arranged in a line. These contacts project above and below the insulative base. Each post has a retaining tang at the top, in the shape of a harpoon-like arrow-point. The point enters a corresponding aperture in the hollow housing and locks therein, due to the cold flow of the insulative material. In this way the housing is held to the base to provide an enclosure for the switch without the use of further fastenings.

Similarly, each stationary contact may have the form of a solderable or IC socket enterable terminal in the portion that projects below the base. It is anchored in the base by a tight-fitting slot construction.

A plurality of rotary cams are oriented in planes parallel to the base and thus to the board upon which the switch is mounted in use. Each cam presses outwardly upon one or more cam-followers of one or more conducting members, or "walking-beams". Each walking-beam has a first beam, a second part, or web, and a second beam lying in a plane parallel to the first beam. One end of each beam has an electrical contact and at the opposite end thereof has a cam follower. These are staggered in a given walking-beam; at one end of the walking-beam there is a follower on one beam and an electrical contact on the other beam, while at the other end of the walking-beam the follower and the contact are reversed as to the beams.

Each beam is installed with a pre-load stress, so that a central stationary contact and both of the end stationary contacts are contacted by the beam.

Upon rotating the cam, when a lobe is presented to the camfollower portion of a beam, the contact (opposite) end of the same is lifted away from its companion stationary contact post. Due to the flexural stress in the web portion of the walking-beam the other contact on the other beam is forced all the more firmly into contact with its companion stationary contact post. This provides desirable switching action with a minimum of parts.

This configuration can be duplicated on the other side of one cam, or even on a total of four sides of the cam, thus giving a number of independent contact systems in a small space. Additionally, this configuration can be duplicated axially along a given rotor, should five to eight systems actuated by the same rotor be required. The basic construction comprehends plural axially adjacent cams having different lobe configurations, with walking-beams and stationary contacts to match.

DESCRIPTION OF THE PREFERRED EMBODIMENTS

Figure 1:
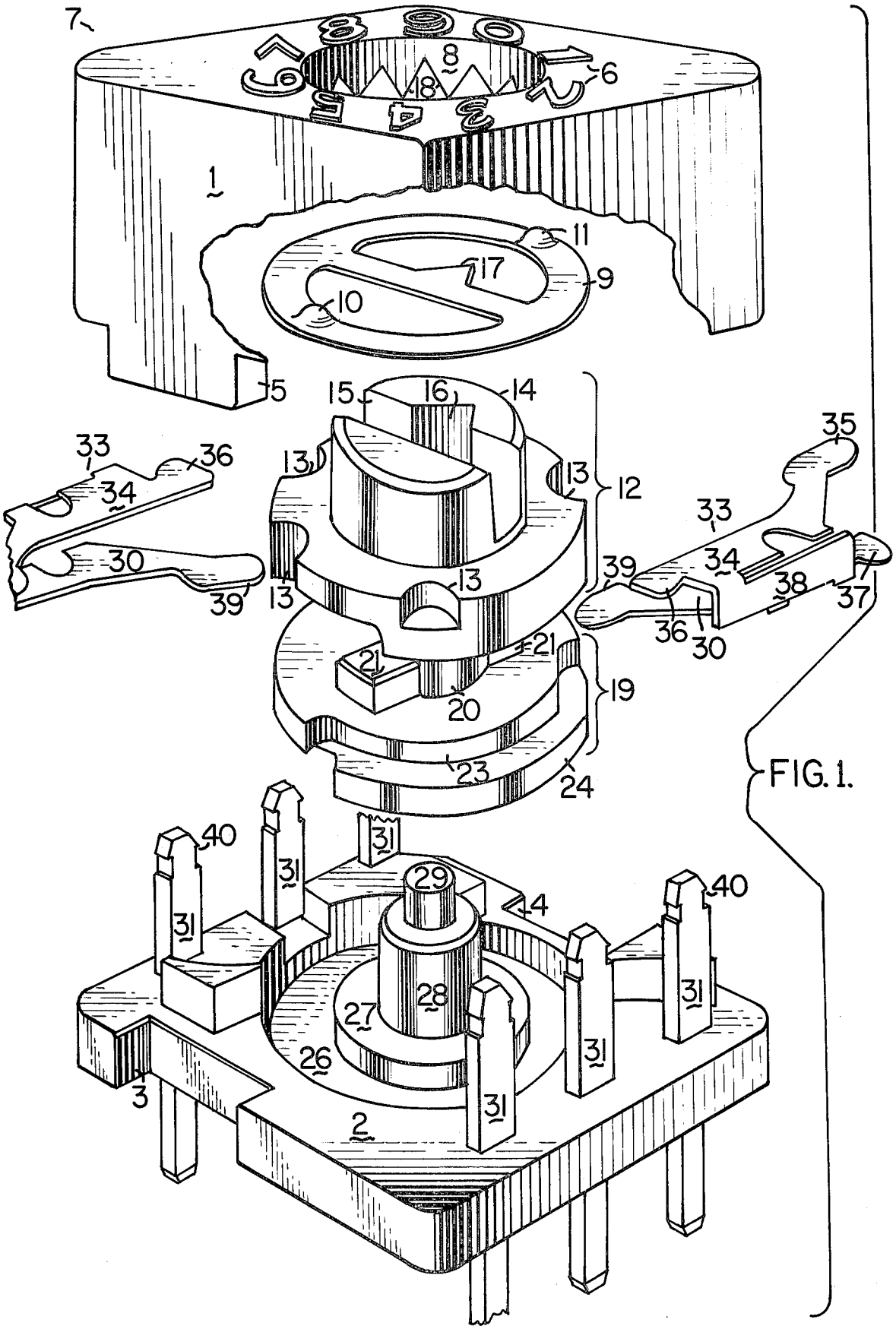
FIG. 1 is an exploded perspective view of the switch.

In FIG. 1, numeral 7 indicates generally the switch enclosure, having insulative housing or cover member 1 and base 2.

The housing is typically a hollow rectangular parallelopiped having a square cross-section, in which the sides extend downward from a centrally-apertured top for about half of the extent of one side of the square. One corner may be formed with a small 45° cut-off portion to enable easy determination of the orientation of the switch.

Base 2 has two staggered peripheral slots 3 and 4, to receive corresponding interlocking projections from housing 1, of which projection 5 is seen in FIG. 1. The staggered slot configuration allows the housing and the base to be assembled in only one way. This preserves the integrity of the rotor position-indicating numerals 6, which may include, but is not limited to, numerals 1 through 0 (10).

The base and housing are preferably fabricated of a plastic material having good dimensional stability and nominal hardness, of which glass-filled nylon is an example.

The surface of the top of the housing carries circular aperture 8, the inside of which is surrounded by axial serrations 18. The latter coact with detent ring 9 to provide circumferential detenting of the rotor.

Ring 9 has oppositely disposed upward dimples 10 and 11, which fit into the serrated depressions 18 to give the detenting function. One such dimple would accomplish this, but the opposed pair of dimples avoids transverse stress on the rotor structure.

Rotor 12 has an upper portion 14 that serves as a slotted manual actuator. A small blade screwdriver, or equivalent, may be placed in slot 15, and rotation of the same moves the rotor from one detent position to another.

A triangular-shaped indentation 16 is provided at one side of slot 15, being centrally located along the length of the slot. The indentation serves a dual purpose; to accept a companion triangular-shaped projection 17 of detent ring 9, and to serve as a rugged indicator of the position of the rotor by pointing to one of the circumferentially disposed numerals 6 upon the top of the housing.

The slotted part of rotor 12 supports the detent ring circumferentially. The axial load of the detent ring is supported by small axial boss 29.

Rotor 12 is also formed with certain indentations 13 which constitute a radial cam.

Figure 7:
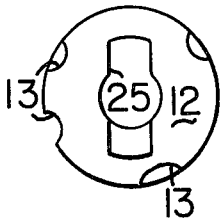
FIG. 7 is a bottom plan view of a cam.

Typically, a second cam 19 is disposed below rotor 12 and is rotationally driven by it. The cam has a concentric aperture 20 and flanking that a radial rectilinear raised key 21. The latter engages a companion radial keyway within the bottom rotor 12 that cannot be lucidly shown in FIG. 1, but which is shown in FIG. 7 at 25.

Cam 19 has an upper cam contour 23 at reduced radius, and in the example shown in FIG. 1 has a circumferential extent approaching 180°. Additionally, lower cam contour 24 has a similar shape, but circumferentially oppositely disposed to the contour of upper cam 23. The lower cam contour actuates a set of contacts at a different circumferential position of rotor 12 from the actuation of other contacts by the upper cam contours.

The cam contour in each case is determined by the coded switching output desired. Thus, it may have a circumferentially short depression, as 13 in the upper cam, it may exceed 300° in circumferential length, or it may have any circumferential length between these extremes, depending upon the code to be executed.

The basic configuration and switch functioning of the contacts is "Form C"; i.e., a single-pole double-throw switch (SPDT).

Electrical contact is normally closed between all of the three aligned stationary contacts because of the pre-stressed condition imposed upon the beams comprising the walking-beam structure. Depending upon adjacent cam configurations, electrical contact may be selectively broken to either of the end stationary contacts, or to both of them at one time.

Base 2 has an annular cylindrical depression 26, centrally located with respect to the square peripheral shape of the base. Inside of the depression is flange 27, which rises above the depression and acts as an axial bearing face to cam 19.

Axial boss 28 surmounts flange 27 and nests within concentric aperture 20 of cam 19, acting as a stationary bearing for the latter.

Small diameter axial boss 29 surmounts axial boss 28. It engages a correspondingly small aperture in rotor 12, not seen in FIG. 1, but which will be understood.

Plural, typically aligned, electrically conductive stationary contacts 31 are force fits into slots in base 2. These are typically disposed in groups of three along an edge of the approximately square base 2. The contacts have solderable, or socket insertable, terminal extensions beneath the base, and upward extensions having harpoon-like arrow points at the top of each contact. These points, tangs 40, engage identically spaced apertures, which may be small slots or equivalent blind holes within housing 1. Because of an essentially irreversible deformation of the apertures the housing retains the points and the housing and base are locked together.

With this construction the assembly of the whole switch is extremely simple and inexpensive in manufacture. It is only necessary to first assemble all of the internal parts, in position, and then to press the housing and base together. This can be accomplished with the fingers of one hand, or with a simple tool.

Figure 5:
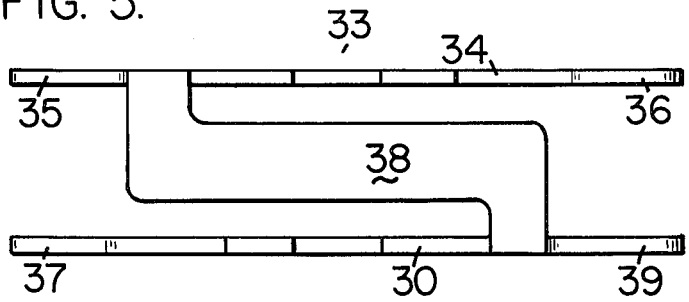
FIG. 5 is a detail elevation view of the same.
Figure 4:
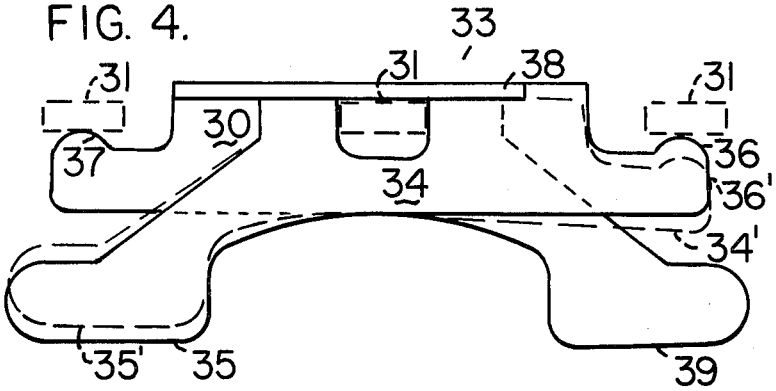
FIG. 4 is a detail plan view of a "walking-beam" element.
Figure 9:
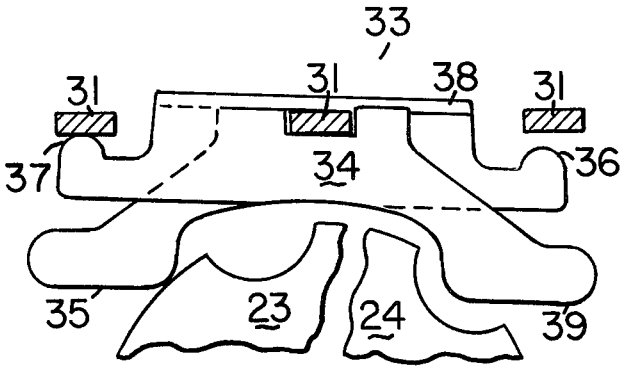
FIG. 9 is a fragmentary view showing the interaction of the fixed and movable contacts and plural cam surfaces in a left-hand make-contact position.
Figure 10:
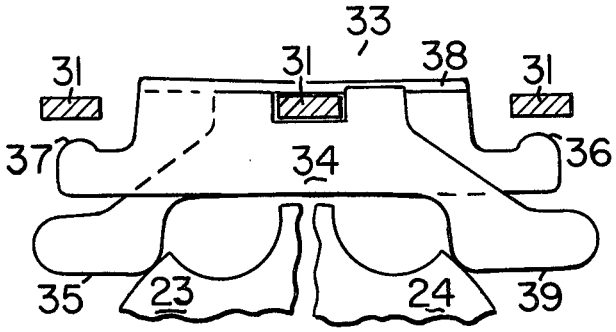
FIG. 10 shows the same in a no-contact position, with the cams having been rotated slightly.
Figure 11:
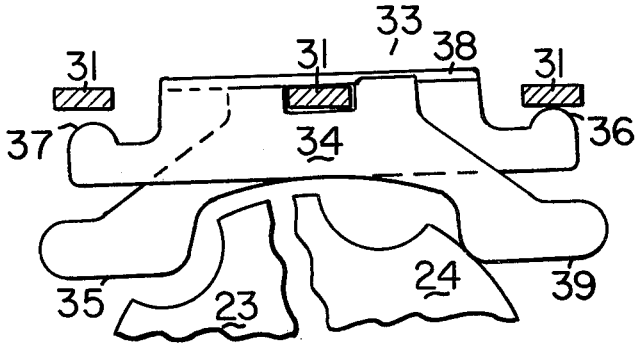
FIG. 11 shows the same in a right-hand make-contact position.

A pair of beam contacts are shown in perspective in FIG. 1 at the sides of the main part of the exploded figure, and these are also shown in FIGS. 4 and 5.

What appears as a single contact 33 is really a pair of contacts that lie in parallel planes and are held together by a common web. An end view of the contact piece has the appearance of a "U" channel. Upper beam 34 has the configuration of an edge-on beam, with a protruding cam-follower 35 at one end and an electrical contact 36 at the other end. Lower beam contact is the same, except that the follower - contact configuration is reversed, end for end; being 39 and 37, respectively.

The web is identified by numeral 38 and it is to be noted that there are opposite-ended slots between the web and the contact beams. Web 38 is attached to upper contact 34 at only one end, near electrical contact 36, and web 38 is attached to lower contact 37 at the opposite end of the web, also near the contact surface of the lower contact.

This slotted web configuration provides beam contacts that are springy as a whole in the plane of each beam. Should the U shape of the walking-beam be devoid of the slots, the contact structure would be inoperatively rigid; as is known for the U structural shapes employed in steel for buildings, bridges, and similar structures.

In assembling the switch, walking-beam 33 is pushed down vertically over a group of three upstanding stationary contacts 31. Web 38 is disposed on the outside of center contact 31, which contact may also be termed a stationary member. Beam contact ends 36 and 37 lie on the inside of the two end contacts 31, respectively. Contacts 36 and 37 press edge-on against corresponding stationary contacts 31.

In the plural cam configurations of 12 and 19, when cam follower 35 of an opposite contact 36, for example, is riding upon a minimum radius of a cam surface, as at 13 or 23, then the contact is electrically closed; i.e., contact portion 36 is firmly pressed against the adjacent stationary contact 31 because of the pre-stressing of the web of walking-beam 33.

When the cam follower rides upon a maximum radius of a cam surface, as at 24, then the contact at the opposite end of the follower is electrically open; i.e., contact portion 36 is raised radially away from the adjacent end of stationary contact 31 because the prestressing force upon the web of walking-beam 33 is overcome. The motion of contact portion 36 is radially inward; toward the center of the whole structure.

This flexure is shown in FIG. 4. The unflexed beam contact 34 is shown in full lines. The three upstanding stationary contacts 31 that are involved are shown in dotted lines. It will be noted that the right-hand contact of beam contact 34 (unflexed) is electrically and mechanically in contact with the right-hand upstanding stationary contact 31.

The flexed beam contact 34' is shown in dotted lines. At the left a maximum radius projection (a lobe) on a cam that has not been shown but is located below the figure, has pressed the cam follower of beam 34' upward. The central upstanding stationary contact 31 acts as a fulcrum in this flexure process. Thus, in "walking-beam" or seesaw style, the contact at the right is forced away from right-hand stationary contact 31. The mechanical and electrical contact is thus broken. Web 38 is further stressed.

Meanwhile, because left-hand contact 37 of beam 30 is joined mechanically through the whole walking-beam 33 via web 38 to beam contact 34; contact 37 is pressed all the harder against the left-hand stationary contact 31. Thus, there is no electrical contact malfunctioning of the electrical beam contact for which the beam has not been actuated.

It will be recognized again that the switching configuration of this switch is "normally closed" for the electrical contacts. Only when web 38 is further stressed is a contact opened.

The central stationary contact 31 is the common electrical contact of a beam pair, such as 34 and 30, and also acts as the fulcrum for the walking-beam, as has been mentioned.

When a cam follower is urged outward from the center of the switch structure as a whole, then the electrical contact at the other end of the beam is opened. Such contact functioning is unobviously different from the known cantilever arm having "normally open" electrical contacts. Such an arm is substantially without stress until it is actuated to close the electrical contacts. Moreover, the cantilever type of lever is different from the central fulcrum type of lever.

A suitable material for all of the contacts is a copper alloy, such as beryllium copper. The finished contact may be gold-plated for anti-corrosion reasons, to enable low level (low voltage or low current) circuits to be switched.

The switch may be fabricated in any size. However, small size is a very important present day attribute for a circuit element, and this invention fulfills that need. The external size of the insulative enclosure may be as small as 9 millimeters (mm) square by 6 mm high. Beam contact 34 may be 5 mm long, 1 mm wide, and 0.127 mm thick. Each stationary contact 31 may be 9 mm long, 0.6 mm wide and 0.3 mm thick.

Figure 2:
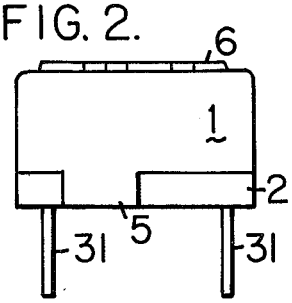
FIG. 2 is an assembled elevation view of the switch.

FIG. 2 shows an external elevation of the assembled switch. Normally, three aligned external terminals that are integral parts of stationary contacts 31 are provided along each of two opposite sides of the enclosure. The groups of three are normally spaced 0.76 cm apart in rows and 2.54 mm apart in each row to thereby make entry into the known standard DIP (dual-in-line package) socket that is typically used for mounting and making electrical connections to integrated circuits. The six terminals may also enter six terminal holes in a printed circuit board known in the art, and may be dip soldered to the printed circuit connections thereof.

Besides this switch having plural external connection terminals that can be electrically opened or closed, circuit connections in digital code may be opened and closed by a suitable combination of contacts and shape of the cams internally involved. An indentation in the cam, such as 13, allows the beam contact involved to remain closed. A lobe of greater radius on the cam, such as immediately adjacent to the indentation, causes the beam contact involved to open. In lower cam 19 the inner radius section 23 provides closed contacts, such as 36 and 37, for several successive detent positions.

With a ten position switch; i.e., ten detent positions, a one pole binary code is possible. This may be either a BCD 1-2-4-8, or the same with complement only. Also, the code may be a two-pole repeating, or a one-pole five-position repeating.

Figure 3:
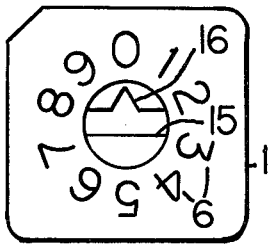
FIG. 3 is an assembled plan view of the switch.

FIG. 3 shows the top of the housing. The normally cast raised numerals 6, the triangular-shaped pointer indentation 16, and screwdriver slot 15 may be seen.

Figure 6:
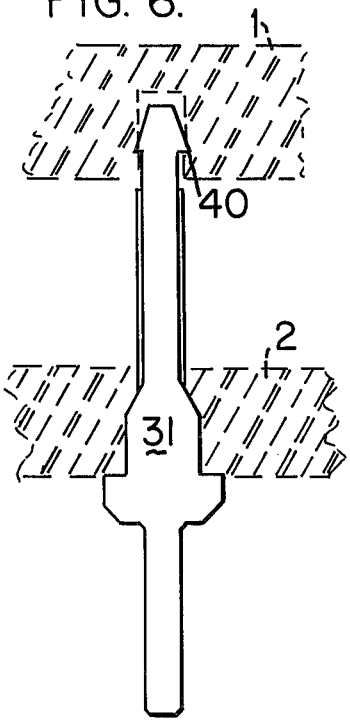
FIG. 6 is a detail view of a stationary contact, showing the retaining tang.

FIG. 6 shows one stationary conductive contact 31, having a tang 40 at the upper end; housing 1 in phantom with the tang entering thereinto, and base 2 in phantom to illustrate that terminals 31 cannot be pulled upward through base 2 due to the projections on terminals 31.

FIG. 7 shows the bottom plan view of rotor-cam 12. Raised key 21 is received into radial slot 25 in lower cam 19. This locks the two rotating members together, so that these rotate as a unit.

Figure 8:
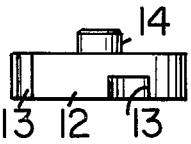
FIG. 8 is an elevation view of a cam.

FIG. 8 shows an elevation of rotor-cam 12. The elements thereof that have been previously pointed out are seen in a different aspect.

It will be recognized that the stressed beam structure of this invention is operable if only a first part 34, a beam, and a second part 38, a web, of a conductive beam 33 are provided. The stress performance is the same as with the full "U" shape; which shape requires a third part 30 lying in a plane parallel to the first part 34.

I claim:

1. The method of electrical switching which includes the method steps of;

(a) simultaneously establishing electrical contact between three stationary electrical conductors by mechanically stressing a fourth electrical conductor, and (b) selectively breaking an end electrical contact between the three said electrical conductors by asymmetrically mechanically increasing the stress upon said fourth electrical conductor.

2. A plural contact rotary switch, comprising;

(a) a hollow insulative housing (1) having internal apertures, (b) an insulative base (2), (c) plural spaced conductive contacts (31) rigidly stationarily aligned to project above and below said insulative base, (d) a retaining tang (40) at the upper extremity of each said conductive contact to enter and engage each said internal aperture in said housing to lock said housing to said base, (e) conductive contact means (33) within said housing, and (f) rotary means within said housing bearing upon said contact means to selectively alter the electrical connection between said plural spaced conductive contacts.

3. The switch of claim 2, in which;

(a) said spaced conductive contacts (31) that extend through said insulative base are formed to constitute both external mechanical mounting and electrical connection means.

4. The switch of claim 2, in which said housing additionally includes;

(a ) an assymetrically positioned projection (5) upon a side of said housing (1) to key into said base (2), (b) a centrally disposed cylindrical aperture (8), and (c) indicia (6) surrounding said aperture.

5. A rotary plural-contact switch, comprising;

(a) an electrically insulative enclosure (7), (b) a revolvable rotor (12), having cams (19, 13) within said enclosure, (c) plural spaced conductive contacts (31) stationarily aligned within said enclosure, (d) a conductive beam (33) stressed fixedly in place between said spaced conductive contacts, and (e) a said cam bearing upon said beam to open the electrical contact between a said spaced conductive contact and said beam, upon said beam being stressed to a greater degree by said cam.

6. A rotary plural-contact switch, comprising;

(a) an electrically insulative enclosure (7) having a cylindrical aperture (8), (b) a revolvable rotor (12) having plural radial cams (19,13) with lobes, said rotor nested in said cylindrical aperture, (c) plural spaced conductive contacts (31) stationarily aligned in pairs peripherally of said rotor within said enclosure, (d) a stationary member (31) between each said pair of contacts, and (e) a conductive beam (33) having a web stressed between said stationary member and the adjacent said pair of contacts;

a cam of said rotor in mechanical contact with said beam, whereby engagement of a said lobe with a said beam stresses the web of said beam to open the electrical contact between said stationary member and at least one of said spaced contacts.

7. The switch of claim 6, which additionally includes;

(a) serrations (18) within said insulative enclosure (7) surrounding said cylindrical aperture (8), (b) a detent spring (9) having dimples (10,11) to selectively engage serrations (18), and (c) a diametral web to mechanically drive said spring, which carries a projection (17) to indicate the circumferential position of the rotor.

8. The switch of claim 6, in which said conductive beam (33) comprises;

(a) a first part (34) disposed edge-on to a said spaced conductive contact (31) at one end (36) of said first part, (b) a follower (35) shaped upon the opposite end of said first part to engage a said radial cam (19), and (c) a second part (38) at right angles to said first part attached to said first part only near the one end (36) of said first part;

said second part engaging a said stationary member (31) under mechanical stress to provide electrical contact pressure.

9. The switch of claim 8, which additionally includes;

(a) a third part (30) disposed in a parallel plane to said first part and attached to said second part, and (b) a said follower (39) upon said third part at the end opposite thereon to the end having the follower on said first part.

10. The switch of claim 6 in which;

(a) at least two pairs of spaced conductive contacts (31) are disposed oppositely with respect to a said radial cam (19) to provide a plurality of electrical contacts operative by one said radial cam.

11. The switch of claim 6, in which;

(a) plural said conductive beams (33) are axially differently spaced, and (b) plural radial cams (19,13) are axially differently spaced to actuate said plural conductive beams with respect to spaced conductive contacts (31) by one said revolvable rotor (12).

12. The switch of claim 6, in which;

(a) the upper portion (14) of said rotor (12) is nested in said cylindrical aperture (8), and (b) said upper portion has a slot (15) and an index (16) externally accessible with respect to said enclosure (7).

* * * * *